United States Patent [19]

Elliott

[11] Patent Number: 4,609,405

[45] Date of Patent: Sep. 2, 1986

[54] APPARATUS FOR FEEDING A DIFFUSER

[75] Inventor: Hilton F. Elliott, Durban, South Africa

[73] Assignee: Huletts Sugar Limited, Mount Edgecombe, South Africa

[21] Appl. No.: 513,104

[22] Filed: Jul. 12, 1983

[51] Int. Cl.[4] ..... C13D 1/12

[52] U.S. Cl. ..... 127/3; 209/245

[58] Field of Search ..... 127/3, 5, 6, 42, 43; 209/242, 245, 254

[56] References Cited

U.S. PATENT DOCUMENTS 1,793,613 2/1931 Hoefling ..... 209/245

2,781,908 2/1957 Gollbach ..... 209/245

3,566,944 3/1971 Tilby ..... 127/42

*Primary Examiner*—Richard V. Fisher

*Assistant Examiner*—W. Gary Jones

*Attorney, Agent, or Firm*—Ladas & Parry

[57] ABSTRACT

The invention relates to diffusers and in particular to sugar cane diffusers in which the diffuser includes means to feed the material to be extracted into the diffuser and also rake means which are constrained to move in a predetermined horizontal plane and to remove material above that plane in order to provide a uniform distribution of the material on the width of the diffuser sieve.

2 Claims, 2 Drawing Figures

APPARATUS FOR FEEDING A DIFFUSER

FIELD OF THE INVENTION

This invention relates to diffusers and in particular to feeding thereof.

DISCUSSION OF PRIOR ART

Sugar cane in comminuted form is fed to a diffuser through a distributive conveyor to form a bed on a sieve after which it is passed through the diffuser.

Several means have been proposed to distribute the cane uniformly over the width of the sieve but none of these has provided a good solution under varying operating conditions. The problems which result from an uneven distribution seriously affect diffuser performance.

OBJECT OF THE INVENTION

It is an object of the present invention to provide a substantially evenly distributed bed by simple means.

DEFINITIONS OF THE INVENTION

According to the invention a method of feeding a diffuser includes the step of introducing an excess of material to be extracted having regard to the available space for the material, and then raking off the excess.

Apparatus for carrying out the method of the invention includes means to feed the material into the diffuser and rake means constrained to move in a predetermined horizontal plane and adapted to remove material above that plane. The removed material is preferably returned to the feed means.

The rake means may take the form of an endless band or chain conveyor, having a plurality of tines, extending outwardly of the band.

Thus, the material may be introduced to fall on to the top bight of the conveyor and is then carried to the end of the bight whence it falls to one side of the diffuser for the space between the lower bight and the sieve to become full across its width, the tines serving to maintain a constant level, the excess material being raked to a chute which may lead back to the feed hopper of the diffuser. The level of material on the diffuser sieve may be adjusted by raising or lowering the rake conveyor relative to the diffuser body.

An embodiment of the invention is described below with reference to the accompanying drawings in which.

Figure 1:
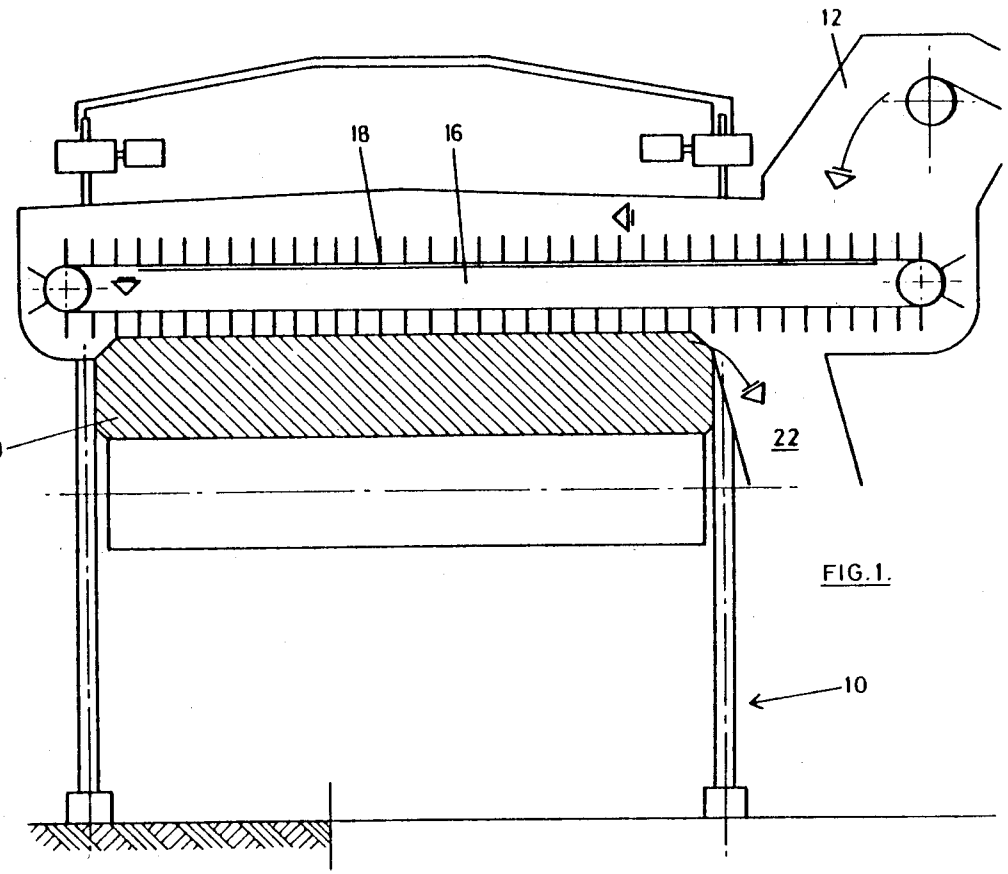
FIG. 1 is a side view of a feed arrangement according to the invention.
Figure 2:
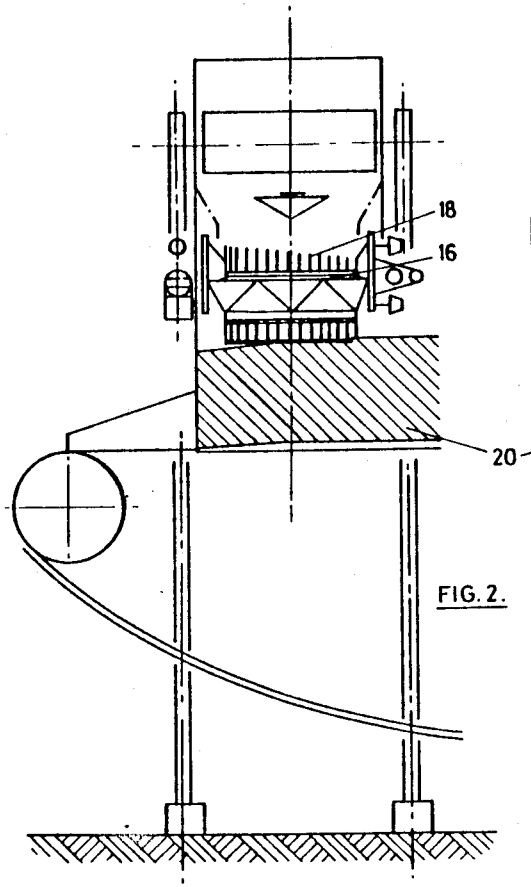
FIG. 2 is an end view thereof.

In the drawings a diffuser denoted generally by reference 10 includes a feed hopper 12 by means of which the material to be extracted falls on to an endless conveyor 16, the band having a plurality of tines 18. A bed 20 of the material is formed, the tines of the conveyor ensuring that a constant level is maintained. Excess material is raked off to fall through chute 22. FIG. 1, of course, only shows the feed end of the diffuser.

The amount of excess of cane may be used as a control means of the feed rate of the cane. For example a conveyor may be located in association with the chute 22, the conveyor transferring the excess cane to a measuring device, which automatically varies the feed rate of the new cane.

I claim:

1. In combination with a diffuser, an apparatus for feeding the diffuser including means to feed sugar cane material to be extracted into the diffuser, rake means to remove excess cane, said rake means constrained to move in a predetermined horizontal plane, wherein the rake means takes the form of an endless band or chain conveyor having a plurality of tines extending outwardly of the band and means are provided to measure the amount of excess cane, and further means are provided to control the feed rate of cane according to the measured amount of the excess cane.

2. The apparatus of claim 1 in which means are provided to return the removed material to the feed means.

* * * * *